US011358759B2

(12) United States Patent
Yang

(10) Patent No.: US 11,358,759 B2
(45) Date of Patent: Jun. 14, 2022

(54) CONTAINER WITH LID OPENER

(71) Applicant: Zhejiang Hengfeng Top Leisure Co., Ltd., Wukang Town (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 94 days.

(21) Appl. No.: 16/988,985

(22) Filed: Aug. 10, 2020

(65) Prior Publication Data

US 2022/0041345 A1 Feb. 10, 2022

(51) Int. Cl.
*B65D 43/26* (2006.01)
*B65D 43/02* (2006.01)

(52) U.S. Cl.
CPC ..... *B65D 43/265* (2013.01); *B65D 43/022* (2013.01); *B65D 2543/00092* (2013.01); *B65D 2543/00888* (2013.01)

(58) Field of Classification Search
CPC .... B65D 43/024; B65D 43/265; B65D 43/26; B65D 43/022; B65D 43/0214; B65D 43/0202; B65D 39/16
USPC ..... 220/285, 284, 260, 804, 801, 796, 791, 220/789, 780, 318, 315, 212.5, 212, 710.5
See application file for complete search history.

(56) References Cited

U.S. PATENT DOCUMENTS 571,794 A * 11/1896 Record ..... B65D 43/265 220/285
1,366,265 A * 1/1921 Kurt ..... B65D 43/022 220/285
1,673,693 A * 6/1928 McLelland ..... B65D 51/04 220/282
3,184,096 A * 5/1965 Cheeley ..... B65D 17/508 220/260
4,407,423 A * 10/1983 Walter ..... B65D 47/0838 220/260
5,244,113 A * 9/1993 Stymiest ..... B65D 47/0885 215/396
5,285,917 A * 2/1994 Hoffmann ..... B65D 50/069 215/211
2020/0255189 A1* 8/2020 Liu ..... B65D 43/0204
2021/0269200 A1* 9/2021 Ou ..... B65D 45/327

* cited by examiner

*Primary Examiner* — Robert J Hicks
(74) *Attorney, Agent, or Firm* — Thompson Coburn LLP

(57) ABSTRACT

A container has a lid that is removably attachable to the container and configured to cover an opening of the container when attached to the container. The lid has a body with a top that extends away from the container when the lid covers the opening of the container, and a bottom which is opposite the top. The body has an arm with an actuator portion and an extension. The actuator portion is configured to move the arm between a retracted position and an extended position relative to the body. When the arm is in the retracted position relative to the body, the extension is at first distance from the top of the body. When the arm is in the extended position relative to the body, the extension is at a second distance from the top of the body which is greater than the first distance.

18 Claims, 7 Drawing Sheets

CONTAINER WITH LID OPENER

BACKGROUND AND SUMMARY

The disclosure is directed to a container having a lid with an opener that facilitates separating the lid from the container to allow access to an interior of the container. The container may be a drink or beverage container.

DETAILED DESCRIPTION

Figure 1:
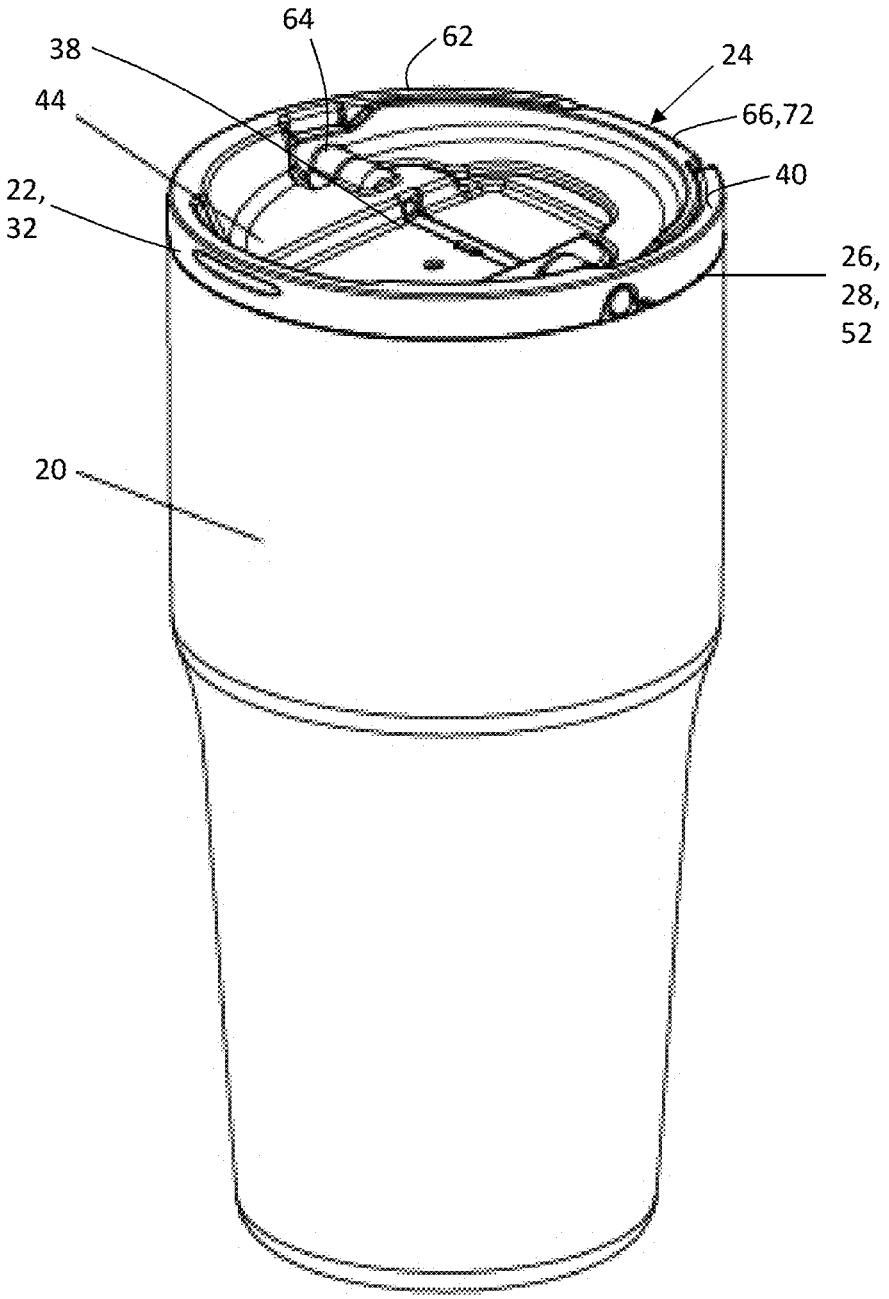
FIG. 1 is a perspective view of an exemplary container with a lid opener.
Figure 2:
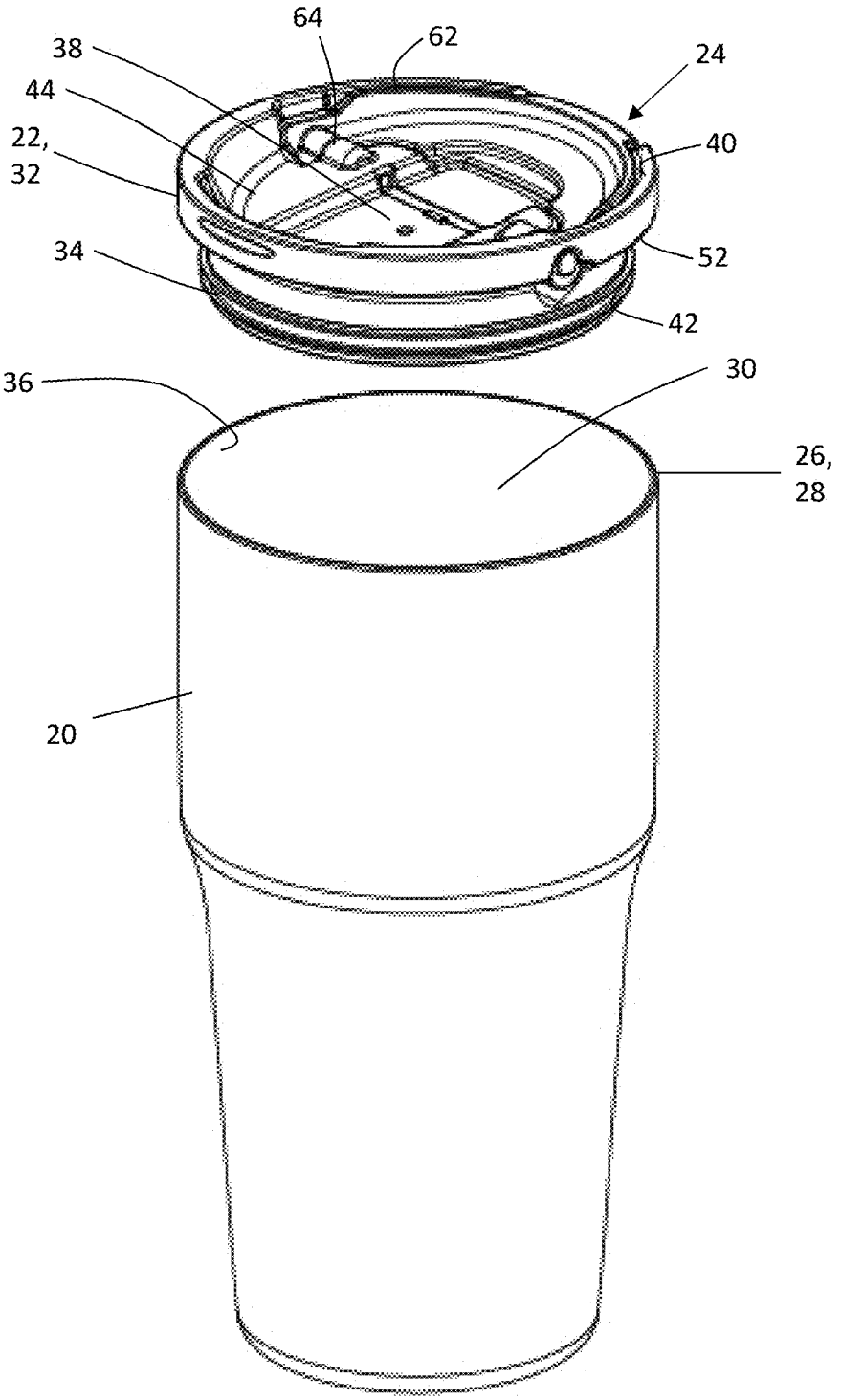
FIG. 2 is an exploded perspective view of the container of FIG. 1 showing the lid removed from an opening of the container.
Figure 3:
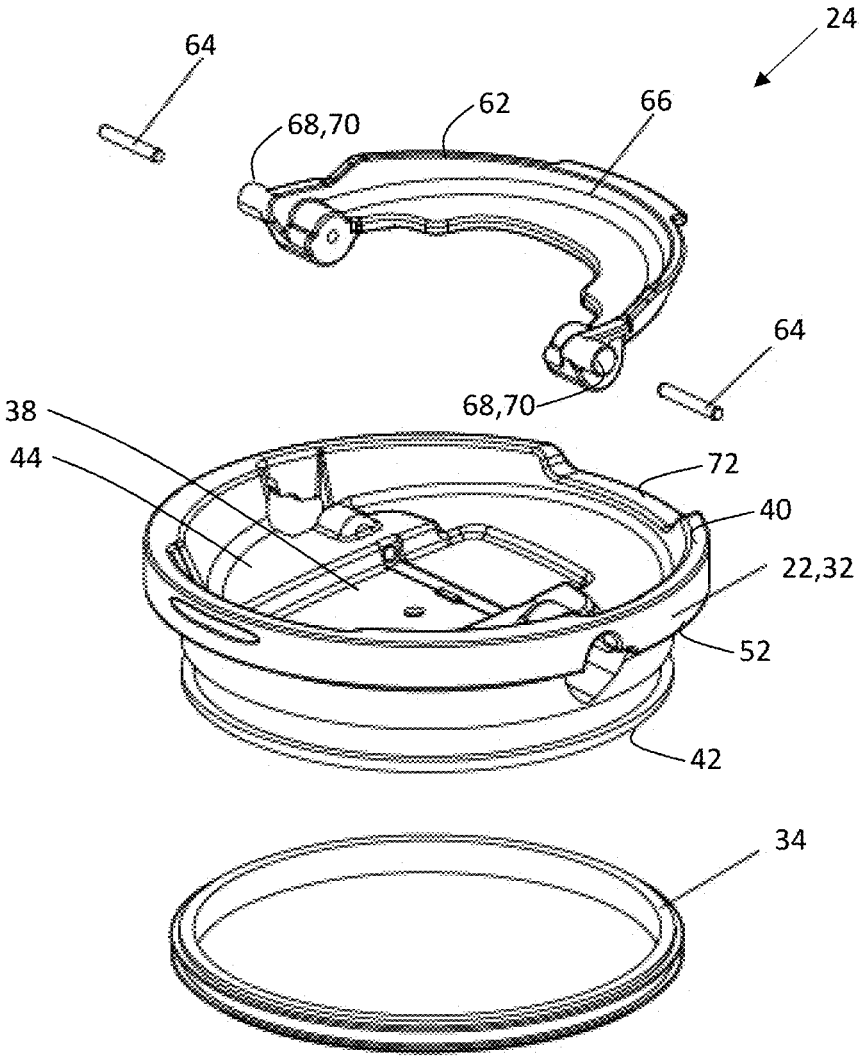
FIG. 3 is an exploded perspective view of the lid of the container of FIG. 1 showing a body of the lid, a seal ring of the body, and an arm of the lid opener pivotally connected to the body.
Figure 4:
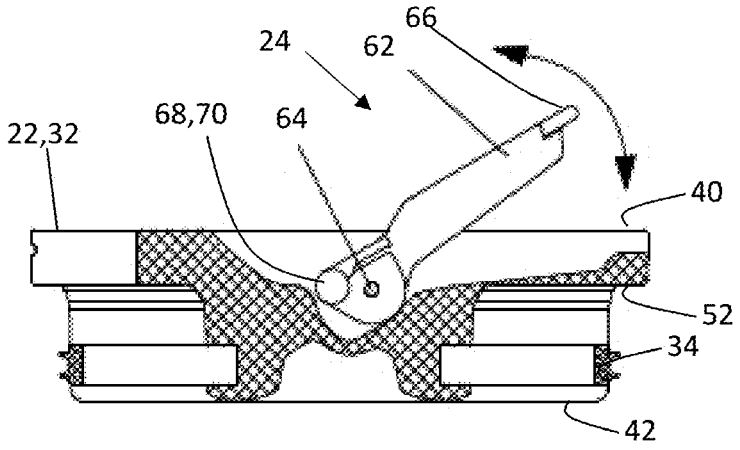
FIG. 4 is a side cross-sectional view of the lid of FIG. 3.
Figure 5:
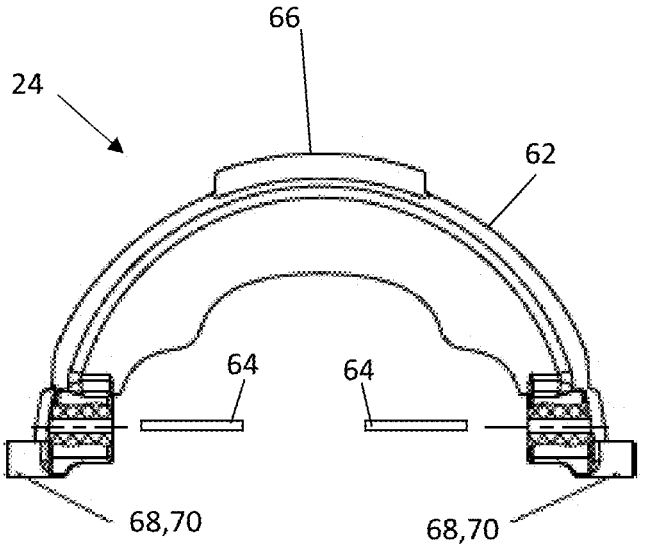
FIG. 5 is a front view of the arm of FIG. 3.
Figure 6:
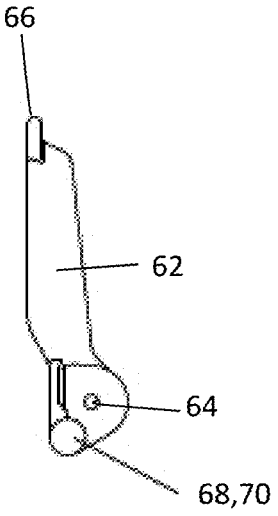
FIG. 6 is a side view of the arm of FIG. 5.

FIG. 1 shows an exemplary container 20 and a lid 22 with an opener 24 incorporated into the lid. The container 20 may be a beverage container, or another personal use container for containing fluids or solids. The container 20 may have a rim 26 defining an opening 28 into an interior 30 of the container. The lid 22 may be removably attachable to the container 20 and may be adapted and configured to cover the opening 28 when attached to the container. The lid 22 may have a body 32 with a seal ring 34. The lid 22 may cover the opening 28 of the container 20, and the seal ring 34 may engage an inner wall 36 of the container to reduce the potential for the contents of the container to leak or spill from the container. The body 32 may also have an aperture (not shown) to allow the user to sip the contents of the container through the lid 22. The aperture may have a closure 38 which may slide or pivot over the aperture as desired by the user.

As will become evident from the disclosure that follows, the lid opener 24 which may be integral with the body 32, makes it easier for the user to remove the lid 22 from the container 20, for instance, when refilling the beverage container or washing the beverage container. The exemplary container 20 with lid opener 24 eliminates issues with conventional beverage containers where the lid is often tightly press fit on the container and not easily removed, or the issue where the contents of the container is inadvertently spilled when the lid is pried off the container, which is especially problematic when the contents of the container is hot.

The body 32 of the lid 22 may have a top 40 and a bottom 42. The top 40 of the body may extend away from the container when the lid covers the opening of the container. The bottom 42 of the body may extend through the opening 28 into the interior 30 of the container 20 when the lid 22 covers the opening 28 of the container. The bottom of the body may also extend along and seal against an outer surface of the container as a cap with or without any portion of the body extending through the opening of the container. The bottom 42 may be irregularly shaped and need not be flat. Likewise, the top 40 may be irregularly shaped and need not be flat. As shown in the drawings, the top 40 of the body has a recess 44 and inclined surfaces in the recess. The aperture may be positioned at the end of the recess 44 at the bottom of the incline so as to have the furthest depth in the recess in the top 40 of the body. The aperture closure 38 may slide along the incline of the recess 44 or may pivot across the incline of the recess. As shown the drawings, the top 40 of the body and the recess 44 have multiple surfaces to accommodate the closure, the aperture and the lid opener 24 and provide a low, neat profile, as will be described.

The body 32 of the lid may also have a shoulder 52 intermediate of the top 40 and bottom 42 of the body that faces the rim 26 when the lid 22 is attached to the container 20 and the lid covers the opening 28. The shoulder 52 may extend around part of or the entirety of the outer periphery of the body 32. Alternatively, the shoulder may be located in a pocket of the body and face a portion of the rim. At least a portion of the shoulder 52 may define a plane that is parallel with at least a portion of the rim 26 of the container when the lid 22 is connected to the container 20. At least a portion of the rim 26 of the container may also define a plane that is parallel to at least a portion the shoulder 52 when the lid 22 is connected to the container 20. The lid opener 24 allows the shoulder 52 to be spaced from the rim 26 to allow the user to easily remove lid 22 from the opening 28 of the container.

The body 32 of the lid 22 may also have an arm 62 which forms part of the opener 24. The arm 62 may have a pivot connection 64 to the body 32 allowing the arm to move between a retracted position of the arm relative to the body and extended position of the arm relative to the body. As shown in the drawings, the pivot connection may comprise an axle pin extending through a hole in the arm and a corresponding journal in the recess 44 of the top 40 of the body 32. The arm may also be hingedly connected to the body, for instance, via a live hinge, allowing the arm to move between a retracted position of the arm relative to the body and extended position of the arm relative to the body. The arm may also be slidingly connected to the body allowing the arm to move between a retracted position of the arm relative to the body and extended position of the arm relative to the body. As will be explained in greater detail below, the arm 62 may be moved from the retracted position to the extended position to separate the lid 22 from the container 20. The arm 62 may have an actuator portion 66 and an extension 68. The pivot, hinge or connection of the arm to the body may be disposed between the extension and the actuator portion. The arm 62 may be arcuate with first and second ends 70, and each of the ends may have the extension 68 and the pivot connection 64 to the body with the actuator portion 66 intermediate the first and second ends. The arm 62 may also be bifurcated with first and second ends, and each of the ends may have the extension and the pivot connection to the body with the actuator portion intermediate the first and second ends. For the arcuate or bifurcated configurations of the arm 62, the pivot connection 64 may extend from each end 70 into the body 32. As shown in the drawings, the recess 44 of the top of the body has surfaces adjacent each end of the arm that have journals to receive an axle pin for each end 70 of the arm. The arm 62 may have one end with the extension and pivot connection to the body, and a corresponding single journal formed in the recess of the top of the body.

The extensions 68 and actuator portion 66 may be integral with or monolithically formed in the arm 62. The extension 68 may have a rounded shaped, for instance, a circular, oval, cam, tear drop shape. The extension 68 may also have a polygonal shape that may include rounded corners. The actuator portion 66 may be a tab projecting from the arm 62 or may be a portion of the arm, for instance, a distal portion of the arm. The arm 62 and actuator portion 66 may be shaped to approximate the shape of the body 32 so as to allow the arm and actuator portion to be at least partially nested within the recess 44 at the top of the body when the arm is in the retracted position. Preferably, a majority of the arm 62 is disposed within the recess 44 when the arm is in the retracted position relative to the body so that no more than a minority of the arm projects from the recess beyond the top 40 of the body. Even more preferably, a substantial portion of the arm 62 is disposed within the recess 44 when the arm is in the retracted position so that no more than an insubstantial portion of the arm projects from the recess beyond the top 40 of the body. Even more preferably, an entirety of the arm 62 is disposed within the recess 44 when the arm is in the retracted position so that no portion of the arm extends from the recess beyond the top 40 of the body. Likewise, preferably, a majority of the actuator portion 66 is disposed within the recess 44 when the arm 62 is in the retracted position relative to the body so that no more than a minority of the actuator portion 66 projects from the recess beyond the top of the body. Even more preferably, a substantial portion of the actuator portion 66 is disposed within the recess 44 when the arm 62 is in the retracted position so that no more than an insubstantial portion of the actuator portion projects from the recess beyond the top 40 of the body. Even more preferably, an entirety of the actuator portion 66 is disposed within the recess 44 when the arm 62 is in the retracted position so that no portion of the arm actuator extends from the recess beyond the top 40 of the body. As shown in the drawings, a cut-out 72 is provided in the top 40 of the body 32 to accommodate the actuator portion 66 of the arm 62 so that no portion of the arm or actuator portion extends from the recess 44 beyond the top of the body.

Figure 7:
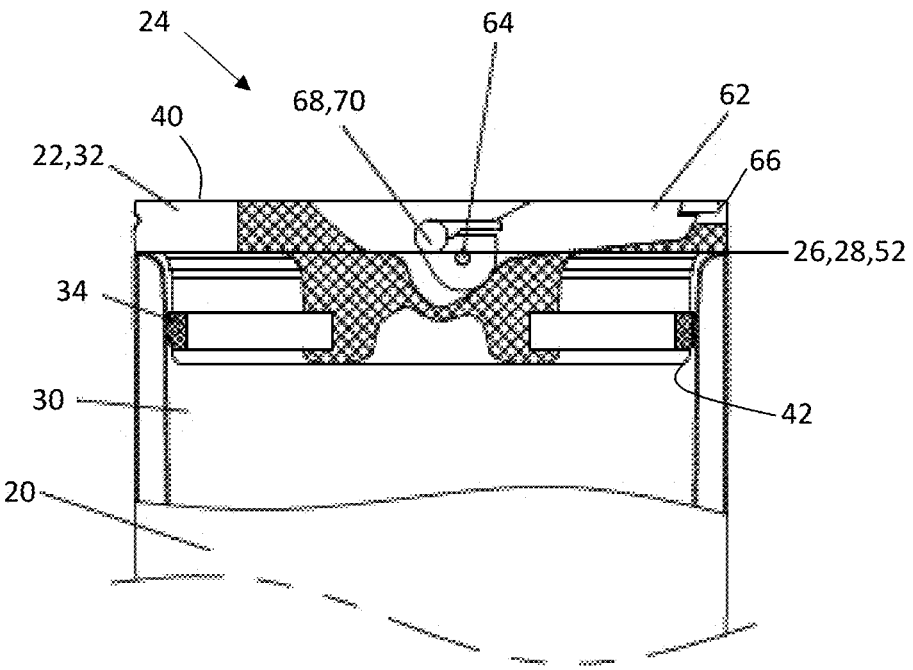
FIG. 7 is a partial, enlarged cross-sectional view of the lid covering the opening of the container with the arm in a retracted position relative to the body.
Figure 8:
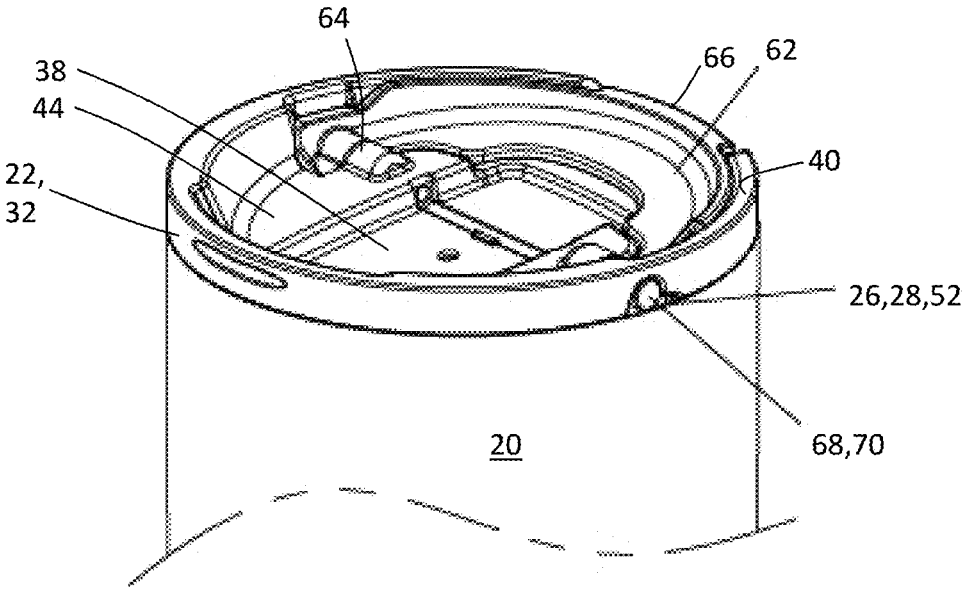
FIG. 8 is a partial, perspective view of the lid covering the opening of the container with the arm in the retracted position relative to the body.
Figure 9:
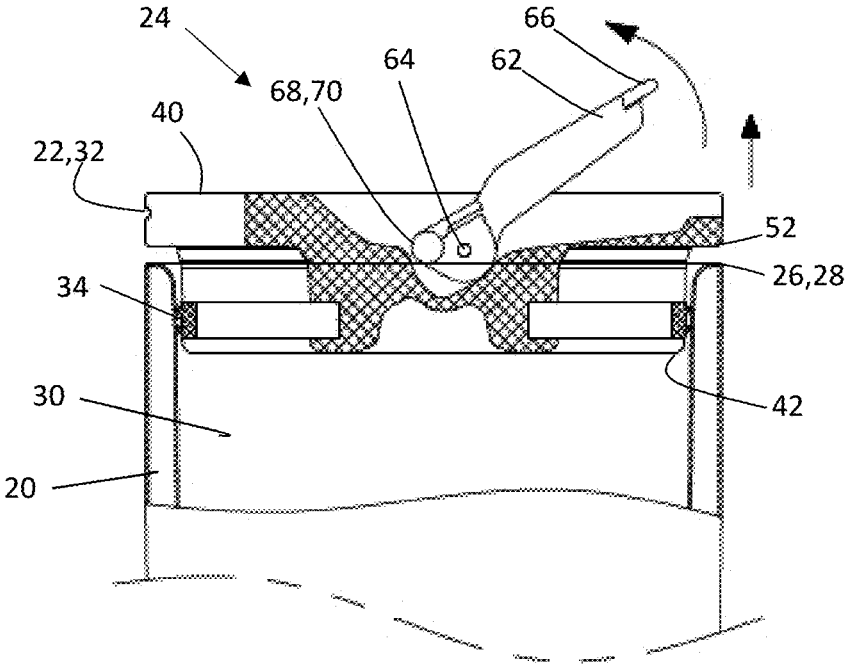
FIG. 9 is a partial, enlarged cross-sectional view of the lid covering the opening of the container but being partially removed from the container with the arm moving from the retracted position to an extended position relative to the body.
Figure 10:
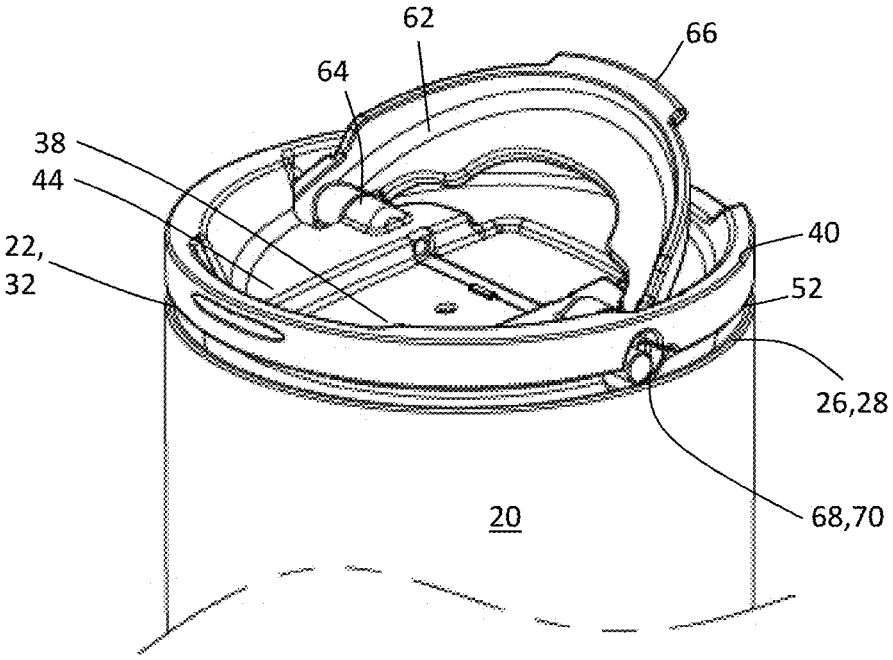
FIG. 10 is a partial, perspective view of the lid covering the opening of the container but being partially removed from the container with the arm moving from the retracted position to the extended position relative to the body.
Figure 11:
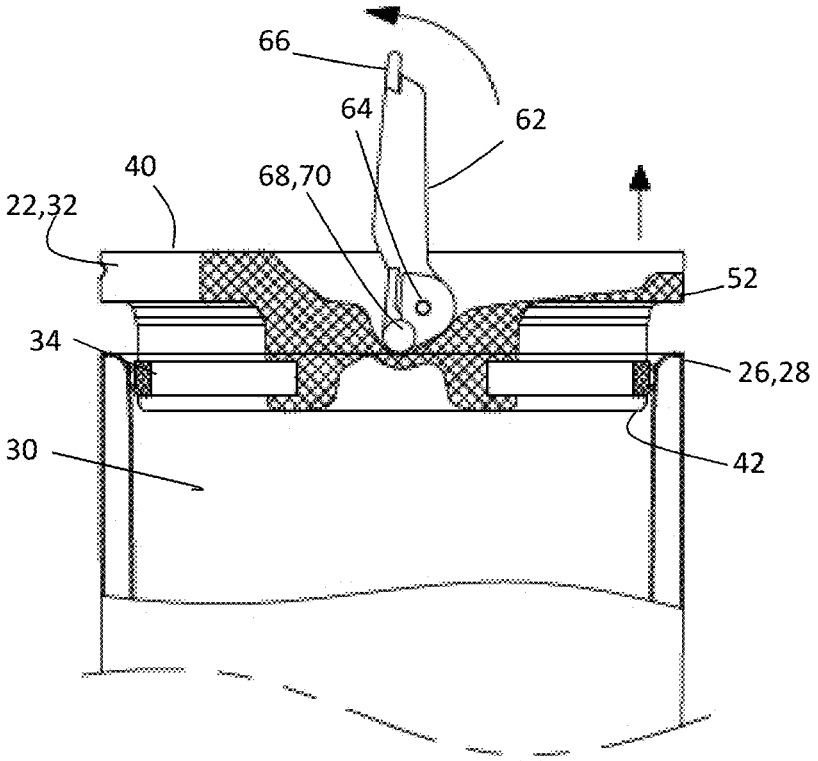
FIG. 11 is a partial, enlarged cross-sectional view of the lid covering the opening of the container with the arm in the extended position relative to the body and the lid more separated from the container than shown in FIGS. 9 and 10.
Figure 12:
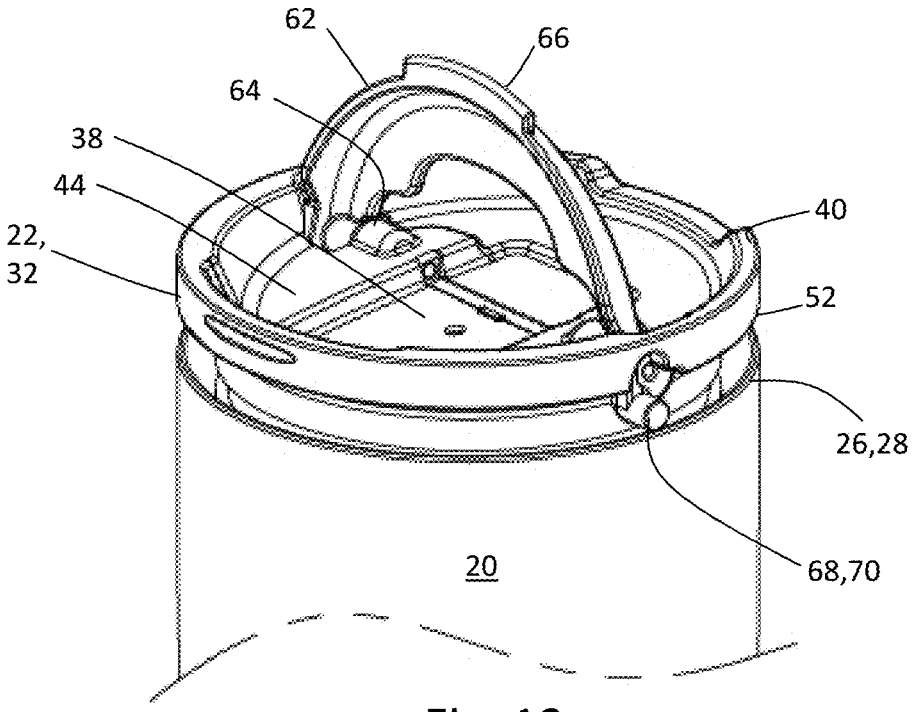
FIG. 12 is a partial, perspective view of the lid covering the opening of the container with the arm in the extended position relative to the body and the lid more separated from the container than shown in FIGS. 9 and 10.

Making reference to FIGS. 4-12, the arm 62 may be pivoted between the retracted position of FIGS. 7-8, and the extended position of FIGS. 11-12. With the lid 22 positioned in the opening 28 of the container and the arm 62 in the retracted position relative to the body 32, the shoulder 52 of the body may be abutting or adjacent to the rim 26 of the container. In this position, the extension 68 may also be abutting or adjacent to the rim 26 of the container. When the arm 62 is moved from the retracted position to the extended position relative to the body, the extension 68 moves away (e.g., radially pivots) from the top 40 of the body toward the bottom 42 of the body. The motion of the arm 62 from the retracted position to the extended position relative to the body causes the extension 68 to bear on the rim 26 and separate the lid 22 from the container 20. During motion of the arm 62 from the retracted position to the extended position, the extension 68 may move from a position above the shoulder 52 where the extension is not urged against the rim 26 to a position below the shoulder where the extension bears against the rim. Making reference to the sequence of drawings in FIGS. 7-12, as the arm 62 moves from the retracted position to the extended position, the body 32 of the lid 22 is lifted up, and the rim 26 of the container 20 and the body 32 of the lid 22 become separated. As the arm 62 moves from the retracted position to the extended position during separation of the lid 22 from the container 20, the rim 26 and the pivot connection 64 become spatially separated. Preferably, movement of the arm 62 from the retracted position to the extended position is sufficient to fully separate the lid 22 from the container 20. Alternatively, movement of the arm 62 from the retracted position to the extended position provides sufficient separation of the lid 22 from the container 20 to allow the user to insert his or her fingers between the lid and the container (e.g., between the shoulder 52 and rim 26) and complete the separation by a gentle upward motion of the lid relative to the container. The extension 68 and pivot connection 64 may be radially offset to provide generally vertical motion of the lid relative to container as the arm 62 moves from the retracted position to the extended position.

To allow the lid 22 to be connected to the container 20 at the opening 28, the reverse steps may be performed. The arm 62 may be pivoted from the extended position of FIGS. 11-12 to the retracted position of FIGS. 7-8. When the arm 62 is moved from the extended position to the retracted position relative to the body, the extension 68 moves away from the bottom 42 of the body toward the top 40 of the body. During motion of the arm 62 from the extended position to the retracted position, the extension 68 may move from a position below the shoulder 52 to a position above the shoulder where the extension is in a position to clear the rim 26 and allow the shoulder of the body to be abutting with or adjacent to the rim of the container when the lid 22 is placed on the container over the opening 28. When the lid 22 is placed on the container over the opening 28, the extension 68 may also be slightly abutting with or adjacent to the rim 26 of the container.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit. Additionally, the terms "top", "bottom", "left" and "right" are used for ease of illustration with reference to the orientation and direction associated with the elements as shown in the drawings, and accordingly the elements should not be construed in any limiting sense.

While various embodiments have been described above, it should be understood that they have been presented by way of example only, and not limitation. Thus, the breadth and scope of a preferred embodiment should not be limited by any of the above-described exemplary embodiments.

What is claimed is:

1. A container having a rim defining an opening into an interior of the container, the container having a lid, the lid being removably attachable to the container, the lid being adapted and configured to cover the opening when attached to the container, the lid having a body, the body having a top and a bottom, the top of the body extending away from the container when the lid covers the opening of the container, the bottom of the body being opposite the top of the body, the body having an arm, the arm having an actuator portion and an extension spaced from the actuator portion along the arm, the arm being pivotal relative to the body at a pivot position, the pivot position being between the actuator portion and the extension, the actuator portion being adapted and configured to move the extension and move the arm between a retracted position of the arm relative to the body and an extended position of the arm relative to the body wherein when the arm is in the retracted position relative to the body, the extension is at a first distance from the top of the body, and wherein when the arm is in the extended position relative to the body, the extension is at a second distance from the top of the body, the second distance being greater than the first distance;

wherein when the lid covers the opening of the container and actuator portion is moved from the retracted position of the arm relative to the body to the extended position of the arm relative to the body, the extension bears on the rim and separates the lid from the container.

2. The container of claim 1 wherein the body has a recess in the top of the body and a majority of the arm is within the recess when the arm is in the retracted position relative to the body and a majority of the arm extends from the recess when the arm is in the extended position relative to the body.

3. The container of claim 2 wherein a majority of the actuator portion is within the recess when the arm is in the retracted position relative to the body and a majority of the actuator portion extends from the recess when the arm is in the extended position relative to the body.

4. The container of claim 1 wherein the bottom of the body extends through the opening of the container when the lid is attached to the container at the opening of the container.

5. The container of claim 1 wherein the arm has a pivot connection to the body at the pivot position.

6. A container having a rim defining an opening into an interior of the container, the container having a lid, the lid being removably attachable to the container, the lid having a body, the body having a shoulder that faces the rim when the lid is attached to the container and the lid covers the opening, the body having an arm, the arm being movable relative to the body, the arm having an actuator portion and an extension opposite of the actuator portion along the arm, the arm being pivotal relative to the body at a pivot position, the pivot position being between the actuator portion and the extension, the actuator being adapted and configured to move the extension together with the arm between a retracted position of the arm relative to the body and an extended position of the arm relative to the body, wherein when the arm is in the retracted position relative to the body, the shoulder of the body is at a first distance from the rim of the container, and wherein when the arm is in the extended position relative to the body, the shoulder is at a second distance from the rim of the container, the second distance being greater than the first distance;

wherein when the lid covers the opening of the container and actuator portion is moved from the retracted position of the arm relative to the body to the extended position of the arm relative to the body, the extension bears on the rim and separates the lid from the container.

7. The container of claim 6 wherein the shoulder of the body abuts the rim when the arm is in the retracted position relative to the body.

8. The container of claim 6 wherein the arm has a pivot connection to the body at the pivot position.

9. The container of claim 6 wherein the shoulder extends around at least a portion of the body.

10. The container of claim 6 wherein at least a portion of the rim defines a plane and at least a portion of the shoulder is parallel to a planar portion of the rim when the lid is connected to the container.

11. The container of claim 6 wherein the arm is arcuate with first and second ends, each of the ends comprises the extension that bears on the rim and separates the lid from the container as the arm is moved from the retracted position to the extended position relative to the body, and the pivot position comprises first and second pivot connections to the body, each pivot connection being adjacent a respective end, and the actuator portion is intermediate the first and second ends.

12. A container having a rim defining an opening into an interior of the container, the container having a lid, the lid being removably attachable to the container, the lid having a body, the body having a top and a bottom, the top of the body extending away from the container when the lid covers the opening of the container, the bottom of the body being opposite the top of the body, the body having an arm, the arm having an extension and an actuator portion, the extension being opposite of the actuator portion along the arm, the arm having a pivot connection to the body, the pivot connection being between the extension and the actuator portion, the actuator portion being adapted and configured to move the extension together with the arm between a retracted position of the arm relative to the body and an extended position of the arm relative to the body, wherein when the arm is in the retracted position relative to the body, the rim of container is at a first distance from the pivot connection, and wherein when the arm is in the extended position relative to the body, the rim is at a second distance from the pivot connection, the second distance being greater than the first distance;

wherein when the lid covers the opening of the container and actuator portion is moved from the retracted position of the arm relative to the body to the extended position of the arm relative to the body, the extension bears on the rim and separates the lid from the container.

13. The container of claim 12 wherein the extension moves toward the bottom of the body as the arm moves from the retracted position to the extended position relative to the body.

14. The container of claim 12 wherein the extension moves toward the top of the body as the arm moves from the extended position to the retracted position relative to the body.

15. The container of claim 12 wherein the body has a recess in a top of the body and a majority of the arm is within the recess when the arm is in the retracted position relative to the body and a majority of the arm extends from the recess when the arm is in the extended position relative to the body.

16. The container of claim 15 wherein a majority of the actuator portion is within the recess when the arm is in the retracted position relative to the body and a majority of the actuator portion extends from the recess when the arm is in the extended position relative to the body.

17. The container of claim 12 wherein the extension has a rounded shape.

18. The container of claim 12 wherein the arm has bifurcated ends, each of the bifurcated ends has the extension and the pivot connection to the body.

* * * * *